United States Patent [19]

Sato et al.

[11] Patent Number: 4,552,788

[45] Date of Patent: Nov. 12, 1985

[54] HOT DIPPING METHOD FOR FORMING A METAL OR ALLOY COATING AROUND AN ELONGATED BODY

[75] Inventors: Kenichi Sato; Satoshi Takano; Kenji Miyazaki, all of Osaka, Japan

[73] Assignee: Sumitomo Electric Industries, Ltd., Osaka, Japan

[21] Appl. No.: 564,145

[22] Filed: Dec. 22, 1983

[30] Foreign Application Priority Data

| | | | |
|---|---|---|---|
| Dec. 24, 1982 | [JP] | Japan | 57-234318 |
| Dec. 25, 1982 | [JP] | Japan | 57-233253 |
| Jan. 25, 1983 | [JP] | Japan | 58-11019 |

[51] Int. Cl.[4] ..... B05D 1/18; B05D 3/02

[52] U.S. Cl. ..... 427/374.5; 427/374.6; 427/432; 427/433

[58] Field of Search ..... 427/432, 433, 377, 398.63, 427/398.4, 374.5, 374.6

[56] References Cited

U.S. PATENT DOCUMENTS

| | | | |
|---|---|---|---|
| 3,505,043 | 4/1970 | Lee et al. | 427/433 X |
| 4,287,238 | 9/1981 | Stauros | 427/432 X |
| 4,330,574 | 5/1982 | Pierson et al. | 427/432 X |
| 4,374,873 | 2/1983 | Piedboeuf et al. | 427/433 X |

*Primary Examiner*—Michael R. Lusignan

*Attorney, Agent, or Firm*—Sughrue, Mion, Zinn, Macpeak, and Seas

[57] ABSTRACT

A method for forming a metal coating on an elongated member, specifically, for forming a thick metal coating on a wire or the like, in which an elongated member being drawn through a melt is extracted from the surface of the bath in a gas container. The gas container is supplied with a nonoxidiziing gas, liquid or a mixture. Preferably, the gas, liquid or mixture is supplied at a temperature sufficiently low to prevent oxidation of the surface of the melt and to cool the elongated member rapidly. The bath should contain a structure for causing the gas, liquid or mixture supply thereto to swirl around the elongated member.

6 Claims, 9 Drawing Figures

HOT DIPPING METHOD FOR FORMING A METAL OR ALLOY COATING AROUND AN ELONGATED BODY

BACKGROUND OF THE INVENTION

The present invention relates to a method of forming a metal or alloy coating around an elongated body by continuous hot dipping.

A variety of conventional methods are known for hot dipping of wire or sheet metal. For example, wire can be coated with zinc by an apparatus of the type illustrated in FIG. 1. In this apparatus, a wire indicated at 1 is pulled up vertically from a melt 2 through an accumulation of carbon powder or flux 3 on the surface of the bath 2. During hot dipping, oxidation at the surface of the melt is not negligible. The use of the carbon powder or flux 3 prevents not only oxidation, but also prevents oxidized film from being drawn up together with the wire 1 by squeezing the film under the weight of the carbon powder or flux at the point where the wire exits the bath. However, this technique is not applicable to high-speed operations because the wire 1 in such a case vibrates significantly, producing a gap between the wire and the inner surface of the carbon or flux deposit. As a result, oxidized film unavoidably forms, which adversely affects the appearance of the final product. Thick and uniform coating cannot be attained.

A thick coating can be produced by electroplating, but this method is not economical because it requires a high initial cost and is time consuming.

In the conventional method of forming a tin or solder coating on a wire by hot dipping, the wire is usually passed through a die to remove any oxidized film. However, this method can only produce a thin coating. Accordingly, a technique that ensures the formation of thick and uniform coating has been desired.

SUMMARY OF THE INVENTION

The present invention has been accomplished to eliminate the above described drawbacks of the conventional hot dipping method. A primary object of the invention is to provide a continuous hot dipping method that is adapted to high-speed operation and which yet yields a uniform and thick coating of improved appearance, that is, without the formation of an oxide film.

The method of the present invention is characterized by the placement of a gas container at the surface of a melt at the drawing site. The bottom of the container is submerged in the melt. The top of the container is equipped with a gas discharge port extending in the direction in which the wire or other article to be coated is pulled up. The inside dimension of the gas discharge port is larger than the outside dimension of the wire. According to the present invention, the container is supplied with a nonoxidizing gas, liquid or a mixture thereof.

The term "elongated member" as used herein means a wire, strip, tape or sheet made of iron, steel, copper, nickel, aluminum Nb-Ti, alloys and composites thereof, and the like. These elongated materials are coated, in accordance with the invention with Zn, Zn alloys (e.g. Zn-Al), metals such as Sn, Cu, Pb and Zn, and alloys thereof such as solders.

DESCRIPTION OF THE PREFERRED EMBODIMENTS

Figure 1:
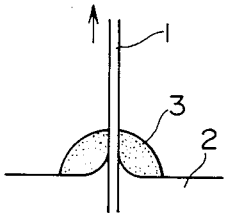
FIG. 1 PRIOR ART
FIG. 1 shows a longitudinal section of a conventional drawing apparatus used for hot dipping.
Figure 2:
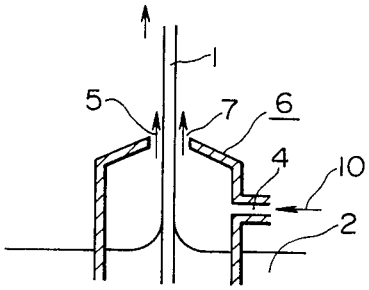
FIG. 2 shows a longitudinal section of one embodiment of a drawing apparatus used to practice the method of the present invention.
Figure 3:
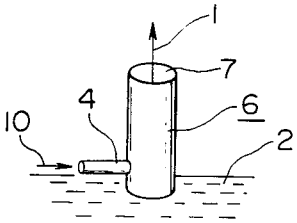
FIG. 3 is a perspective view of the apparatus shown in FIG. 2.

The method of the present invention will hereunder be described with reference to preferred embodiments shown in FIGS. 2 to 7. FIG. 2 illustrates in a cross-sectional view the concept of the present invention. FIG. 3 is a perspective view. In FIGS. 2 and 3, the elongated member 1 to be coated is immersed in a melt 2 and then pulled up through a gas container 6. The container is typically cylindrical or bell shaped, and has a port 4 formed in a side wall thereof. Non oxidizing gas, liquid or mixture thereof 10 is introduced into the container through the port 4. The container has at its top a port 7 through which the gas 10 is discharged. The gas discharge port 7 has an inside dimension greater than the outside dimension of the elongated member to be coated to permit the gas 10 to be discharged from the envelope that surrounds the member 1. The bottom of the gas container 6 is submerged in the melt 2.

According to the method of the present invention, the elongated member 1 in the melt 2 is directed into the gas container 6 and pulled up through the gas discharge port 7 while the nonoxidizing gas, liquid or mixture thereof 10 is fed through the port 4 so as to maintain the atmosphere in the interior of the container nonoxidizing. By so doing, oxidation on the surface of the melt at the drawing site is prevented and a meltplated article having a good appearance is produced. Even if the member 1 is fed at a fast speed and vibrates to some extent, no oxide film which would impair the appearance of the final product will be pulled up together with the article. Furthermore, the member 1 will not contact any solid part of the gas container, so that a coating having a uniform thickness is obtained.

Another advantage of the present invention is that the article 1 can be cooled rapidly by using a cold nonoxidizing gas, liquid or mixture thereof fed into the container 6 and discharged therefrom through the port 7. This rapid cooling prevents sagging of a thick coating and achieves a faster coating operation than in the first embodiment where the gas 10 is used only for the purpose of preventing oxidation.

Examples of a suitable nonoxidizing gas or liquid include $N_2$, $CO_2$, CO, $H_2$, Ar, He, propane gas, natural gas, ordinary cooking/heating gas and mixtures thereof. Liquid nitrogen is preferred, however, because it is easy to handle and is inexpensive. The nonoxidizing gas, liquid or mixture advantageously used at a temperature in a range of minus 195 degrees C. to 0 degrees C. Above 0 degrees C. the cooling effect is insufficient.

Figure 4A:
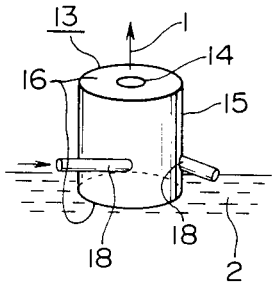
FIG. 4A is a perspective view of another embodiment of a drawing apparatus with which the present invention may be practiced.
Figure 4B:
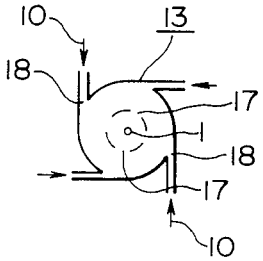
FIG. 4B is a cross section of FIG. 4A.

FIGS. 4A and 4B show another embodiment of the present invention, wherein a drawing device, generally indicated at 13, has a sheathed structure composed of an inner tubular member 14 surrounded by a concentric tubular member 15. The bottom of both tubular members are submerged in the coating 2, and the top and bottom of each tubular member are closed with lids 16. The peripheral wall of the inner tube 14 is provided with a plurality (four in FIGS. 4A and 4B) of slits 17 cut axially at equal intervals. The peripheral wall of the outer tube 15 is provided with a plurality (four in FIG. 4) of ports 18 that permit the gas 10 to be introduced into the tube in a tangential direction. The gas flowing into the space between the inner tube 14 and outer tube 15 is caused to swirl about the member 1. Thus, the drawing device 13 also serves as a vortex-forming device. The swirling gas 10 is blown against the periphery of the member 1 from the four slits 17 at a substantially constant flow rate, and is subsequently discharged from the top of the inner tube 14. The vortex of the gas 10 has the advantage of providing a uniform pressure of the gas surrounding the member 1, thereby achieving uniform and rapid cooling of the member being coated from its outside to its inside. At the same time, the drawing section of the plating bath 2 is held in a nonoxidizing atmosphere and the formation of oxide film is prevented.

The vortex-forming device may employ any construction that causes the gas to rotate about the member 1. Other embodiments of the vortex-forming device are shown in FIGS. 5A, 5B, 6 and 7, wherein reference numerals which are the same as those used in FIG. 2 identify the same components.

The advantages of the method of the present invention will become apparent from the following nonlimiting examples.

EXAMPLE 1

A zinc coating was formed on copper wires (diameter=3.9 mm) by the hot dipping method of the present invention using an apparatus of the type shown in FIG. 3 and by the conventional method using carbon powder. A preliminary treatment was conducted as in the conventional Zn hot dipping consisting of immersion in a liquid lead, washing with HCl, and treatment with a flux. In the method of the present invention, three different gases were used, $N_2$, LPG gas and $CO_2$. The wire feeding speeds employed are listed in Table 1, which also shows the appearance of the final product and the thickness of the Zn coating.

TABLE 1

| Type | Sample No. | Drawing section | Wire feeding speed (m/min) | Appearance | Average Thickness of plating |
|---|---|---|---|---|---|
| Conventional samples | 1 | carbon powder | 15 | some blisters | 20 |
| | 2 | " | 20 | many blisters | 26 |
| Samples according to the present invention | 3 | $N_2$ gas | 30 | smooth surface | 56 |
| | 4 | LPG gas | 30 | " | 58 |
| | 5 | $CO_2$ gas | 30 | " | 55 |

The data for wire samples No. 3 to No. 5 shows that the method of the present invention can achieve high-speed plating of a thick Zn coating having a good appearance. On the other hand, samples No. 1 and No. 2 that were treated at low speeds by the conventional method produced a Zn coating having an undesirably rough appearance.

EXAMPLE 2

A Zn coating was formed on steel wires (diameter=3.2 mm) by the hot dipping method of the present invention using a drawing apparatus of the type shown in FIG. 4 and by the conventional method using a graphite powder. A preliminary treatment was conducted, as in the case of ordinary Zn coating, by the sequence of washing with 20% HCl and treatment with a $ZnCl_2$-$NH_4Cl$ flux. The wire feed speeds employed are listed in Table 2, which also shows the amount of the Zn coating, the uniformity of coating and its appearance. The uniformity of the Zn coating was examined by the procedures specified in Japanese Industrial Standard (JIS) No. H 0401.

TABLE 2

| Type | Sample No. | Drawing section | Wire feeding speed (m/min) | Zn coating ($gm/m^3$) | Uniformity (times/min) | Appearance* |
|---|---|---|---|---|---|---|
| Samples according to the present invention | 1 | vapor of liquid nitrogen | 10 | 273 | 3 | A |
| | 2 | | 15 | 311 | 4 | A |
| | 3 | | 20 | 337 | 4 | A |
| | 4 | | 25 | 352 | 4 | A |
| | 5 | | 30 | 378 | 5 | A |
| Conventional samples | 6 | graphite powder | 10 | 315 | 3 | A |
| | 7 | | 15 | 333 | 4 | B |
| | 8 | | 20 | 362 | 3 | C |
| | 9 | | 25 | 463 | 3 | D |

*D = extremely uneven surface, B = acceptable but needs further improvement, A = smooth surface, C = uneven surface.

The data for samples No. 1 to No. 5 shows that the method of the present invention provides a highly uniform Zn coating with good appearance. Even at a wire feed speed as high as 30 m/min, the advantages of the present invention are not lost. On the other hand, the data for samples No. 6 to No. 9 reveals that the appearance of the wire treated by the conventional method becomes worse as the wire feeding speed increases.

Another disadvantage of the conventional method is that the graphite powder burned and produced a combustion gas that had to be discharged from the drawing apparatus. This is not necessary with the method of the present invention.

EXAMPLE 3

Figure 5A:
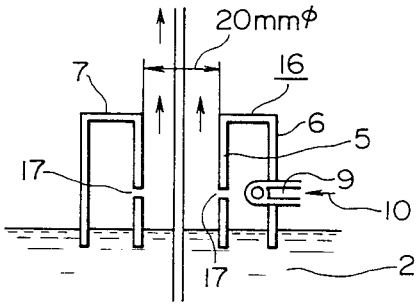
FIG. 5A, 5B , 6 and 7 are cross sections of other embodiments of drawing apparatus that can be used to practice the present invention.
Figure 5B:
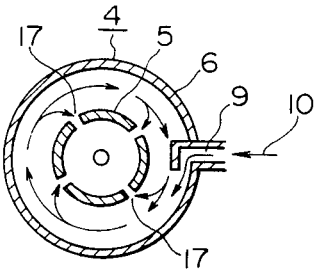

A tin coating was formed on soft copper wires (diameter=0.6 mm) by the hot dipping method of the present invention using drawing apparatuses of the types shown in FIGS. 3, 5A and 5B, as well as by the conventional method using a melt the surface of which was simply covered with a flux ("Azonile" manufactured by Imanishi Chemical Co., Ltd. of Japan). The drawing apparatus 6 shown in FIGS. 5A and 5B used an inner pipe 5 having holes 17 through which a gas 10 was introduced. The gas 10 was a cryogenic gas evaporated from liquid nitrogen. The soft copper wires were degreased, washed with an acid, treated with Azonile, immersed in a liquid tin at a temperature of 280 degrees C. and pulled up through the drawing apparatus. The wire feeding speeds employed are listed in Table 3, which also shows the minimum thickness of the tin coating and its appearance.

TABLE 3

| Type | Sample No. | Drawing section | Wire feeding speed (m/min) | Minimum Thickness (μ) | Appearance |
|---|---|---|---|---|---|
| Conventional samples | 1 | Covered with Azonile | 20 | 1.0 | B |
| | 2 | | 40 | 0.8 | D |
| Samples according to the present invention | 3 | See FIG. 3 | 20 | 3.4 | B |
| | 4 | | 40 | 4.8 | B |
| | 5 | See FIG. 5 | 20 | 6.2 | A |
| | 6 | | 40 | 11.3 | A |
| | 7 | | 60 | 15.6 | A |

The data for samples No. 5 to No. 7 shows that the method of the present invention provides high-speed hot dipping of a thick coating having a good appearance.

EXAMPLE 4

Figure 6:
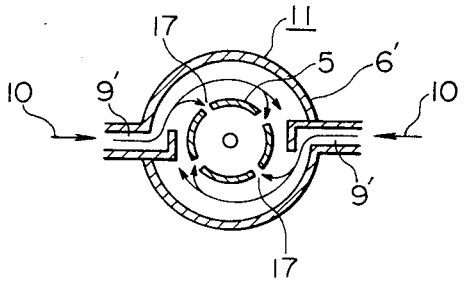
Figure 7:
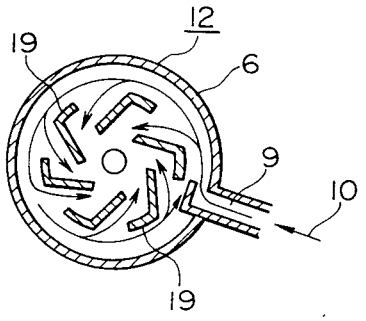

A zinc coating was formed on steel wires (diameter=4.2 mm) by the hot dipping method of the present invention using drawing apparatus of the type shown in FIGS. 6 and 7, as well as by the conventional method using a carbon powder. A cryogenic gas evaporated from liquid nitrogen was used as the cooling gas 10. The preliminary treatment consisted of degreasing in a conventional lead bath, washing with HCl, and treatment with a $ZnCl_2$-$HN_4Cl$ flux. The wires were fed into the melt at a temperature of 465 degree C. at the speeds shown in Table 4. The uniformity of the zinc coating and its appearance are also shown in Table 4.

TABLE 4

| Type | Sample No. | Drawing section | Wire feeding speed (m/min) | Uniformity (times) | Appearance |
|---|---|---|---|---|---|
| Conventional samples | 8 | carbon powder | 15 | 4 | B |
| | 9 | | 20 | 3 | D |
| Samples according to the present invention | 10 | See FIG. 7 | 25 | 4 | B |
| | 11 | | 40 | 5 | B |
| | 12 | See FIG. 6 | 25 | 5 | A |
| | 13 | | 30 | 6 | A |
| | 14 | | 40 | 8 | A |

The data for samples No. 10 to No. 14 shows that the method of the present invention achieves high-speed hot dipping of a uniform coating having a good appearance.

EXAMPLE 5

A Sn coating was formed on copper tapes (0.3 mm thick and 240 mm wide) by the hot dipping method of the present invention using a drawing apparatus of the type shown in FIG. 2 and by the conventional method using a drawing die. The tapes were preliminarily treated with a flux ("Azonile"). In the method of the present invention, three different gases were introduced into the drawing apparatus as in Example 1. The wire feeding speeds employed are listed in Table 5, which also shows the appearance of the final product and the thickness of the Sn coating.

TABLE 5

| Type | Sample No. | Drawing section | Wire feeding speed (m/min) | Appearance | Average thickness of plating |
|---|---|---|---|---|---|
| Conventional samples | 6 | die | 25 | A | 6 |
| | 7 | die | 35 | B | 8 |
| | 8 | die | 45 | C | 10 |
| Samples according to the present invention | 9 | $N_2$ gas | 60 | A | 18 |
| | 10 | LPG gas | 60 | A | 16 |
| | 11 | $CO_2$ gas | 60 | A | 20 |

The data for samples No. 9 to 11 shows that the method of the present invention achieves high-speed hot dipping of a thick coating having a good appearance. On the other hand, samples No. 7 and 8 treated by the conventional method had a poor appearance, although the wires were fed at slow speeds.

ADVANTAGES OF THE INVENTION

The hot dipping method of the present invention achieves the following advantages:

(1) A gas container having its bottom submerged in a plating bath and having a gas discharging port at its top is placed in the surface of the melt. The container is supplied with a nonoxidizing gas, liquid or a mixture thereof. By this arrangement, the oxidation of the surface of the plating bath at a site where the article to be coated is pulled up can be prevented. Since no oxide film forms, a thick coating having a good appearance can be formed on the article, even if the plating speed is increased to such an extent that the article vibrates. Furthermore, by using a cold nonoxidizing gas, liquid or mixture thereof, the article to be plated can be cooled rapidly enough to prevent sagging of the coating being formed.

(2) The method of the present invention requires no mechanical squeezing of the article being coated. Therefore, the article can be freely oscillated in the drawing section so as to provide a coating having a uniform thickness.

(3) The drawing apparatus used in the method of the present invention can be designed to provide a swirling action that causes the nonoxidizing gas, liquid or mixture thereof to form a vortex around the article to be coated. Therefore, the gas around the article has a uniform pressure, resulting in a coating having a uniform thickness.

We claim:

1. A method for forming a coating on an elongated member by continuous hot dipping, comprising the steps of: providing a gas container the bottom of which is submerged below the surface of a melt and which has at its top a gas discharging port that is aligned in the direction of advancement of the elongated member and which has an inside dimension greater than an outside dimension of said elongated member, supplying an interior of said gas container with a nonoxidizing gas, liquid or a mixture thereof supplied at a temperature in the range of −195 degrees C. to 0 degrees C., cold enough to prevent oxidation of the surface of the melt and to cool said elongated member rapidly, and drawing said elongated member through said gas container.

2. The method according to claim 1, wherein said nonoxidizing gas, liquid or mixture thereof is produced from liquid nitrogen.

3. The method according to claim 1, wherein said gas container is provided with a vortex-forming structure which causes said gas, liquid or mixture thereof to swirl around said elongated member.

4. The method according to claim 1, wherein said elongated member is a wire.

5. The method according to claim 1, wherein said bath contains zinc or an alloy of zinc.

6. The method according to claim 1, wherein said bath contains tin or an alloy of tin.

* * * * *